US008897101B2

(12) United States Patent
Kawakami et al.

(10) Patent No.: US 8,897,101 B2
(45) Date of Patent: Nov. 25, 2014

(54) TIMEPIECE FACEPLATE AND TIMEPIECE

(75) Inventors: Atsushi Kawakami, Nagano (JP); Yoshiyuki Obi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 73 days.

(21) Appl. No.: 13/313,326

(22) Filed: Dec. 7, 2011

(65) Prior Publication Data

US 2012/0140604 A1 Jun. 7, 2012

(30) Foreign Application Priority Data

Dec. 7, 2010 (JP) ..... 2010-272895

(51) Int. Cl.
*G04B 37/12* (2006.01)
*G04B 19/10* (2006.01)

(52) U.S. Cl.
CPC ..... *G04B 19/10* (2013.01)
USPC ..... 368/232; 368/234; 368/205

(58) Field of Classification Search
USPC ..... 368/205, 223, 232, 234
See application file for complete search history.

(56) References Cited

U.S. PATENT DOCUMENTS

| | | | | |
|---|---|---|---|---|
| 2004/0032797 | A1* | 2/2004 | Sato et al. | 368/232 |
| 2008/0159083 | A1* | 7/2008 | Kawakami | 368/232 |
| 2008/0247065 | A1* | 10/2008 | Boyd et al. | 359/831 |
| 2009/0091668 | A1* | 4/2009 | Kristoffersen et al. | 349/15 |
| 2009/0126792 | A1* | 5/2009 | Gruhlke et al. | 136/259 |
| 2009/0129210 | A1* | 5/2009 | Yamaguchi et al. | 368/205 |
| 2010/0128187 | A1* | 5/2010 | Brott et al. | 349/15 |

FOREIGN PATENT DOCUMENTS

| | | | |
|---|---|---|---|
| JP | 11-326549 | A | 11/1999 |
| JP | 2002-286867 | A | 10/2002 |
| JP | 2005-189019 | A | 7/2005 |
| JP | 2007-003356 | A | 1/2007 |
| JP | 2009-079941 | A | 4/2009 |
| JP | 4477867 | B2 | 6/2010 |

* cited by examiner

*Primary Examiner* — Amy Cohen Johnson
*Assistant Examiner* — Matthew Powell
(74) *Attorney, Agent, or Firm* — Global IP Counselors, LLP

(57) ABSTRACT

To offer a timepiece faceplate having exceptional transmission of light as well as exceptional aesthetic appearance, and to offer a timepiece provided with the timepiece faceplate, a timepiece faceplate of the invention is provided with a first plate member including a material having an optical transmission property, and a second plate member including a material having an optical transmission property.

7 Claims, 5 Drawing Sheets

TIMEPIECE FACEPLATE AND TIMEPIECE

CROSS-REFERENCE TO RELATED APPLICATIONS

This application claims priority to Japanese Patent Application No. 2010-272895 filed on Dec. 7, 2010. The entire disclosure of Japanese Patent Application No. 2010-272895 is hereby incorporated herein by reference.

BACKGROUND

1. Technical Field

The present invention relates to a timepiece faceplate and to a timepiece.

2. Background Technology

A function required of faceplates for use in solar timepieces (timepieces provided with solar batteries) is the ability to transmit a quantity of light (optical transmission) sufficient for the solar batteries to generate sufficient electromotive force. For this reason, in the past, plastic members with high light transmission have been used as faceplates for solar timepieces. However, plastic typically lacks a high-quality feel, and is inferior in aesthetic appearance as compared with metal materials such as gold, silver, and the like. For this reason, there have been proposed faceplates obtained by causing a metal film comprising a metal material, and provided with an opening, to adhere to a substrate made of plastic, interposed by an adhesive (for example, Patent Citation 1).

However, with faceplates of this kind it has been difficult to achieve an exceptional optical transmission as well as an aesthetic appearance. More specifically, if a relatively high opening ratio of the metal film (the surface area of the opening as proportion of the entire metal film, when the metal film in viewed in a plane) is used in order to ensure transmission of light, the presence of the opening becomes conspicuous, and sufficiently exceptional aesthetic appearance is not obtained despite the use of metal material (metal film). On the other hand, if a low opening ratio of the metal film is used with the aim of improving the aesthetic appearance, transmission of light declines, and generation efficiency of the solar batteries markedly declines.

Also, particularly with methods such as the aforedescribed, the metal film is prone to wrinkling during adhesion of the metal film onto the substrate, and in order to prevent the occurrence of such wrinkles, it is necessary to carry out the adhesion procedure with care, and faceplate productivity is extremely low. Also, even in cases where the adhesion procedure is carried out with sufficient care, it has proven difficult to sufficiently prevent relatively small wrinkles or other flaws from appearing, and it has been exceedingly difficult to impart sufficiently exceptional aesthetic appearance to the faceplates obtained thereby, even in cases where the opening ratio of the metal film is low. Also, because a relatively high proportion of defective products occur, methods such as the aforedescribed are unfavorable from the standpoints of manufacturing yield and resource conservation. Problems such as the aforedescribed are particularly severe in cases where the metal film is relatively thin (for example, 10 μm or less). Also, in cases where the metal film is relatively thin (for example, 10 μm or less), the metal film is prone to tearing during the adhesion procedure, which is disadvantageous from the standpoints of faceplate productivity, manufacturing cost, and resource conservation; and portions of the torn metal film may get dispersed into the atmosphere as fine particulate, posing human health concerns.

Japanese Patent Application Publication No. 11-326549 (Patent Citation 1, see page 3, right column, line 35 to page 4, left column, line 11) is an example of the related art.

SUMMARY

Problems to be Solved by the Invention

It is an advantage of the invention to offer a timepiece faceplate having exceptional transmission of light as well as exceptional aesthetic appearance, and to offer a timepiece provided with the aforedescribed timepiece faceplate.

Means Used to Solve the Above-Mentioned Problems

Advantages such as these are attained through the below-described invention.

The timepiece faceplate of the invention comprises a first plate member having an optical transmission property, and a second plate member having an optical transmission property; wherein a face of the first plate member, which face faces the second plate member, is provided with fine asperities having a function of reflecting and scattering light impinging thereon from a face on an opposite side of the face of the first plate member; and and a face on the side opposite a face of the second plate member, which face faces the first plate member, is provided with fine asperities having a function of reflecting and scattering light impinging thereon from the face facing the first plate member.

Because of this, a timepiece faceplate having exceptional transmission of light (optical transmission) as well as exceptional aesthetic appearance can be offered.

In preferred practice, in the timepiece faceplate of the invention, the asperities present on the first plate member is orderly arranged, with the average pitch thereof being 25 μm or more to 100 μm or less. In so doing, a particularly exceptional aesthetic appearance can be imparted to the timepiece faceplate. In preferred practice, in the timepiece faceplate of the invention, the average height differential of the asperities present on the first plate member is 12.5 μm or more to 50 μm or less. In so doing, a particularly exceptional aesthetic appearance can be imparted to the timepiece faceplate.

In preferred practice, in the timepiece faceplate of the invention, the first plate member has a plurality of the asperities provided in a concentric circle pattern when the timepiece faceplate is seen in plan view. In so doing, a particularly exceptional aesthetic appearance can be imparted to the timepiece faceplate. In preferred practice, in the timepiece faceplate of the invention, the asperities present on the second plate member are orderly arranged, with the average pitch thereof being from 10 μm or more to 25 μm or less. In so doing, a particularly exceptional aesthetic appearance can be imparted to the timepiece faceplate.

In preferred practice, in the timepiece faceplate of the invention, the average height differential of the asperities present on the second plate member is 5 μm or more to 12.5 μm or less. In so doing, a particularly exceptional aesthetic appearance can be imparted to the timepiece faceplate. In preferred practice, in the timepiece faceplate of the invention, the second plate member has a plurality of the asperities of linear form provided substantially parallel to one another when the timepiece faceplate is seen in plan view. In so doing, a particularly exceptional aesthetic appearance can be imparted to the timepiece faceplate. The timepiece of the invention is characterized by comprising the timepiece faceplate of the invention. In so doing, a timepiece with a particularly exceptional aesthetic appearance can be offered. Also, because light from the outside can be transmitted efficiently through the timepiece faceplate, there can be offered a timepiece (for example, a solar timepiece or the like) capable of effectively utilizing outside light.

Effect of the Invention

According to the invention, there can be offered a timepiece faceplate having exceptional transmission of light as well as exceptional aesthetic appearance, and there can be offered a timepiece provided with the aforedescribed timepiece faceplate.

BRIEF DESCRIPTION OF THE DRAWINGS

Referring now to the attached drawings which form a part of this original disclosure.

DETAILED DESCRIPTION OF EXEMPLARY EMBODIMENTS

The preferred embodiment of the invention is described below while referring to the accompanying drawings. The preferred embodiment of the timepiece faceplate of the invention is described first.

Timepiece Faceplate

Figure 1:
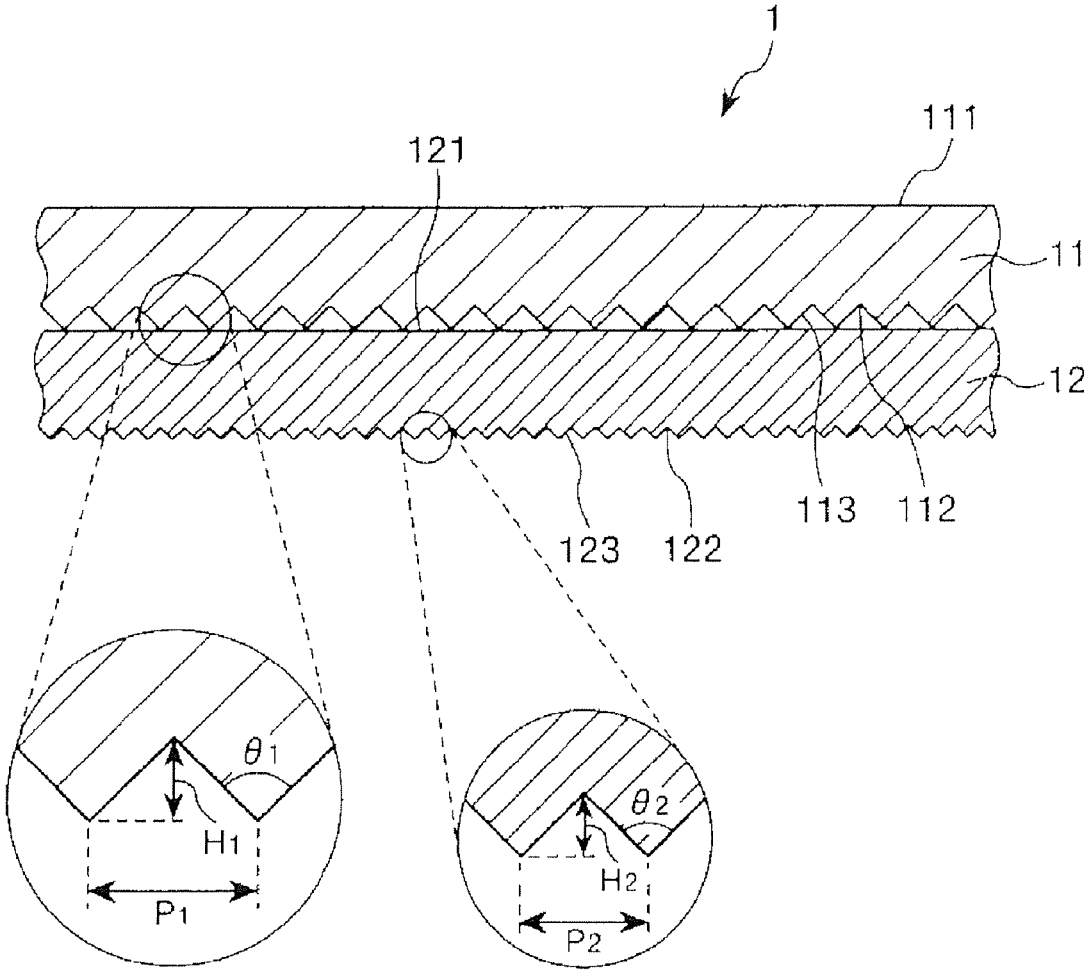
FIG. 1 is a cross sectional view showing a preferred embodiment of the timepiece faceplate of the invention.
Figure 2:
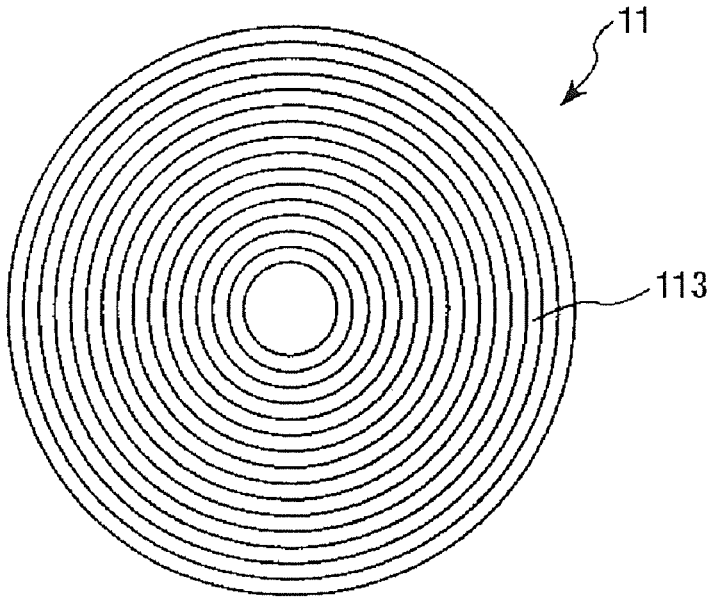
FIG. 2 is a plan view showing in model form an example of a pattern of disposition of asperities present on the first plate member.
Figure 3:
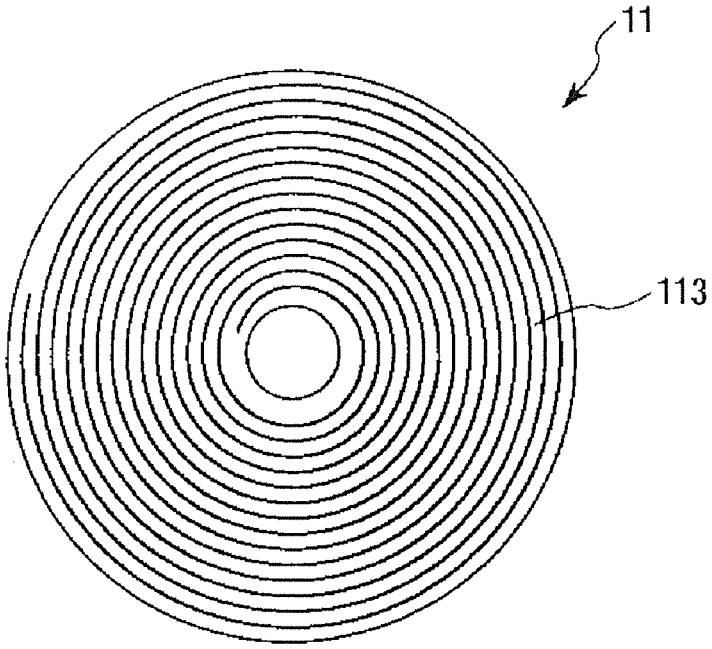
FIG. 3 is a plan view showing in model form an example of a pattern of disposition of asperities present on the first plate member.
Figure 4:
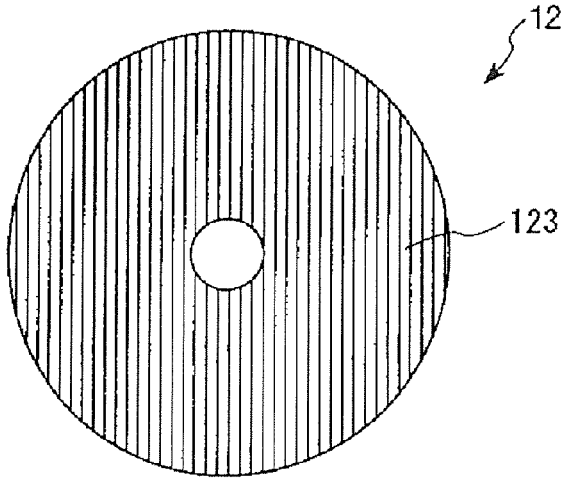
FIG. 4 is a plan view showing in model form an example of a pattern of disposition of asperities present on the second plate member.
Figure 5:
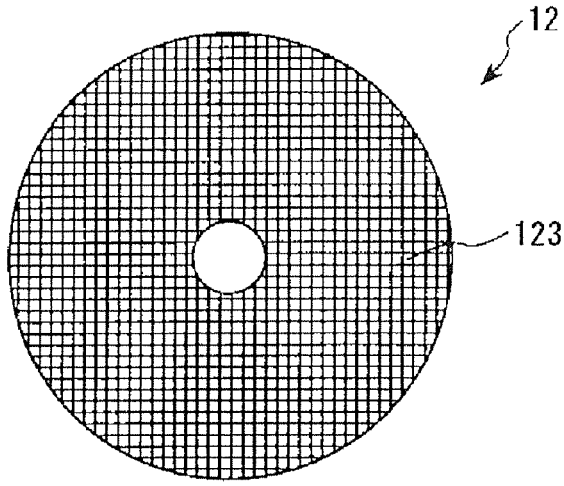
FIG. 5 is a plan view showing in model form an example of a pattern of disposition of asperities present on the second plate member.
Figure 6:
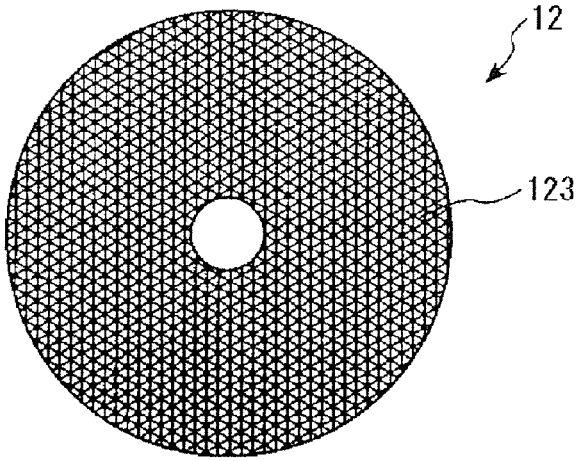
FIG. 6 is a plan view showing in model form an example of a pattern of disposition of asperities present on the second plate member.

FIG. 1 is a cross sectional view showing a preferred embodiment of the timepiece faceplate of the invention; FIGS. 2 and 3 are plan views showing in model form examples of patterns of disposition of asperities present on the first plate member; and FIGS. 4 to 6 are plan views showing in model form examples of patterns of disposition of asperities present on the second plate member.

As shown in FIG. 1, the timepiece faceplate 1 is provided with a first plate member 11 having an optical transmission property, and a second plate member 12 having an optical transmission property. A face (second face) 112 of the first plate member 11 facing toward the second plate member 12 is provided with fine asperities 113 having the function of reflecting and scattering light impinging on a face (first face) 111 on the opposite side thereof, while a face (second face) 122 on the opposite side of the second plate member 12 from a face (first face) 121 which faces toward the first plate member 11 is provided with fine asperities 123 having the function of reflecting and scattering light impinging from the side of the face (first face) 121 which faces toward the first plate member 11.

Painstaking research conducted by the inventors resulted in the discovery that by giving the timepiece faceplate such a configuration, the timepiece faceplate as a whole can be imparted with exceptional light transmissivity and aesthetic appearance. The timepiece faceplate 1 is used with the first face 111 side of the first plate member 11 oriented towards the observer side (the outer front face side).

First Plate Member

The first plate member 11 is composed of material having an optical transmission property. In the invention, "having an optical transmission property" indicates having a quality of transmitting at least a portion of light of the visible range (a wavelength range of 380 to 780 nm), and preferably having a transmittance of light of the visible range of 50% or more, and more preferably transmittance of light of the visible range of 60% or more. As transmittance of light, there can be employed, for example, a ratio ((Y/X)×100[%]), where (X) is a current value observed during the generation of power solely by a solar cell (solar battery) of the same shape as a member (or the timepiece faceplate) being measured, under 1000 lux using as a light source a white fluorescent bulb (an FL20S-D65 fluorescent bulb for inspection purposes (Toshiba)), and (Y) is a current value observed during the generation of power under the same state as above except that the member (or the timepiece faceplate) being measured is placed on the light-source side of the solar cell. In the present specification, unless otherwise noted, "transmittance of light" indicates a value derived under these conditions.

As the material from which the first plate member 11 is composed, there can be cited, for example, various types of plastic materials or various types of glass materials, but in preferred practice the first plate member 11 is composed primarily of a plastic material. Typically, plastic materials have exceptional moldability (degree of freedom in molding), and can be applied in a favorable manner for the manufacture of various shapes of faceplates for a timepiece 1. Also, where the first plate member 11 is composed of a plastic material, there is an advantage in terms of reducing manufacturing cost of the timepiece faceplate 1. Also, because plastic materials typically have exceptional transmission of light (visible light), as well as exceptional transmission of radio waves, where the first plate member 11 is composed of a plastic material, the timepiece faceplate 1 can be applied favorably in a radio wave timepiece as described below. The following description is centered on a description of an example of the first plate member 11 composed primarily of plastic materials. In the invention, "primarily" indicates the component contained in the greatest amount in the material of which a region (member) of interest is composed, and while the content is not limited to any particular value, it is preferably 60 wt % or more, and more preferably 80 wt % or more, and even more preferably 90 wt % or more, of the material of which a region (member) of interest is composed.

Various types of thermoplastic resins, various types of thermal curing resins, and the like may be cited as plastic materials that constitute the first plate member 11; for example, there can be cited polycarbonate (PC), acrylonitrile-butadiene-styrene copolymer (ABS resin), polymethyl methacrylate (PMMA), and other acrylic resins, polyethylene (PE), polypropylene (PP), and other polyolefin resins, polyethylene terephthalate (PET) and other polyester resins, as well as copolymers, blends, and polymer alloys having these as the primary component. A single type, or two or more types of these, may be used in combination (for example, in the form of a blended resin, a polymer alloy, a laminate body or the like). In particular, the first plate member 11 is preferably composed primarily of polycarbonate and/or an acrylonitrile-butadiene-styrene copolymer. In so doing, a particularly exceptional level of strength can be imparted to the timepiece faceplate 1 as a whole. Also, because of the increased degree of freedom of molding (improved ease of molding) of the first plate member 11, a timepiece faceplate 1 of a more complex shape can be manufactured easily and reliably. Also, among the various plastic materials, polycarbonate is relatively inexpensive, and can contribute to further reduction in manufacturing cost of the timepiece faceplate 1. Also, ABS resin has particularly exceptional chemical resistance, and can further improve the durability of the timepiece faceplate 1 as a whole.

The first plate member 11 may contain components besides plastic material. As examples of such components, there may be cited, for example, plasticizers, antioxidants, colorants (including various types of color formers, fluorescent materials, phosphorescent materials, and the like), brightening agents, fillers, and the like. For example, where the first plate member 11 is composed of material containing colorants, the variation of colors of the timepiece faceplate 1 can be expanded.

The first plate member 11 may have a substantially uniform composition in each region thereof, or a composition that differs by region. The refractive index (absolute refractive index) of the first plate member 11 is preferably from 1.500 to 1.650, and more preferably from 1.550 to 1.600. In so doing, reflection and scattering of light as discussed in detail below can be favorably produced, and the timepiece faceplate 1 can be imparted with both exceptional aesthetic appearance and transmission of light. The first plate member 11 has on the second face 112 thereof, which is a principal face on the opposite side from the first face 111, fine asperities 113 having the function of reflecting and scattering light impinging from the first face 111 side.

Incidentally, because the first plate member 11 has optical transmission, part of the light from outside the timepiece faceplate 1 (light from the upper side in FIG. 1) enters into the interior of the first plate member 11. The light entering into the interior of the first plate member 11 advances from the first face 111 side towards the second face 112 side, and a portion thereof exits from the second face 112 side (more specifically, is transmitted through the first plate member 11), but the remaining portion is reflected and scattered by the asperities 113 provided on the second face 112. In so doing, the light which has entered into the interior of the first plate member 11 from the first face 111 side can be made to re-exit from the first face 111 side.

While any number of dispositions of the asperities 113 are possible, in preferred practice they are disposed in a regular fashion, when the first plate member 11 is viewed in plan view. In so doing, the occurrence of unintentional color irregularities and the like can effectively be prevented in regions of the timepiece faceplate 1 (regions seen in plan view). As patterns of disposition of the asperities 113 (patterns of disposition seen in plan view) there can be cited, for example, a pattern of raised ribs and a multitude of grooves disposed in concentric circles (see FIG. 2), a pattern of raised ribs and grooves disposed in a whorl (see FIG. 3), or the like. These also exemplify patterns of disposition of the asperities 123 present on the second plate member 12 to be discussed in detail below.

Among these patterns of disposition of the asperities 113, a pattern of raised ribs and grooves disposed in concentric circles is especially preferred. In so doing, a particularly exceptional aesthetic appearance can be imparted to the timepiece faceplate 1. While the average of the pitch (in particular, the pitch for a direction perpendicular to the lengthwise direction of the raised ribs and grooves on the second face 112) $P_1$ (average pitch) of the asperities 113 is not limited to any particular value, it is preferably 25 μm or more to 100 μm or less, and more preferably 30 μm to 70 μm. Where the average of the pitch $P_1$ (average pitch) of the asperities 113 is a value within the aforedescribed range, a particularly exceptional aesthetic appearance can be imparted to the timepiece faceplate 1.

While the average of the height differential (the height differential of the apical portion of the raised portions (raised ribs) and the floor portion of the recessed portions (grooves)) $H_1$ (average height differential) of the asperities 113 is not limited to any particular value, it is preferably 12.5 μm or more to 50 μm or less, and more preferably from 15 μm to 35 μm. Where the average of the height differential $H_1$ (average height differential) of the asperities 113 is a value within the aforedescribed range, a particularly exceptional aesthetic appearance can be imparted to the timepiece faceplate 1, while imparting the timepiece faceplate 1 with sufficiently high transmission of light.

In the illustrated configuration, the cross-sectional shape (the shape in a cross section perpendicular to the lengthwise direction of the raised ribs and grooves) of the asperities 113 is that of an isosceles triangle. Where the asperities 113 have this cross-sectional shape, light impinging from the first face 111 side can be appropriately reflected and scattered, and particularly high levels of both transmission of light and aesthetic appearance of the timepiece faceplate 1 can be attained. While the apical portion of the asperities 113 ($\theta_1$ in the drawing) is not limited to any particular angle, it is preferably from 70° to 100°, and more preferably 90°. In so doing, light impinging from the first face 111 side can be appropriately reflected and scattered, and extremely high levels of both transmission of light and aesthetic appearance of the timepiece faceplate 1 can be attained.

The first face 111 of the first plate member 11 is preferably a relatively flat (smooth) one. In so doing, a particularly exceptional aesthetic appearance is imparted to the timepiece faceplate 1. The first face 111 of the first plate member 11 may be provided with a motif such as a radial shape, a vortex, or the like. In so doing, variations in the design of the timepiece faceplate 1 can be expanded, and a particularly exceptional aesthetic appearance can be imparted to the timepiece faceplate 1. The surface roughness Ra of the first face 111 is preferably from 0.001 μm to 5.0 μm, and more preferably 0.001 μm to 2.5 μm. In so doing, effects such as the aforedescribed can be brought about even more prominently.

The shape and size of the first plate member 11 are not limited to any particular ones, and are ordinarily determined based on the shape and size of the timepiece faceplate 1 to be manufactured. In the illustrated configuration, the first plate member 11 is one with a flat shape, but one with, e.g., a curved plate shape or the like is also acceptable. The average thickness of the first plate member 11 is not limited to any particular value, but is preferably from 50 μm to 500 μM, more preferably from 100 μm to 450 μm, and even more preferably from 150 μm to 400 μm. Where the average thickness of the first plate member 11 is a value within the aforedescribed range, in the case of implementation of the timepiece faceplate 1 in a solar timepiece, the inherent color of the solar battery can be more effectively prevented from showing through the timepiece faceplate 1, while still having sufficiently high optical transmission, and a particularly exceptional aesthetic appearance (high-quality feel) can be imparted. Also, where the average thickness of the first plate member 11 is a value within the aforedescribed range, the timepiece faceplate 1 can be imparted with sufficiently exceptional mechanical strength, stability of shape, and the like, while effectively preventing any increase in thickness of the profile of the timepiece in which the timepiece faceplate 1 is implemented. Also, while any method may be employed for molding the first plate member 11, compression molding, extrusion molding, injection molding, optical fabrication, or the like may be cited as examples of the molding method used for the first plate member 11. Also, a first plate member 11 provided with the asperities 113 may be manufactured by preparing a plate member devoid of asperities, and then performing a cutting operation or other process thereon.

Second Plate Member

The second plate member 12 is composed of a material having an optical transmission property. As the material from which the second plate member 12 is composed, there can be cited, for example, various types of plastic materials or various types of glass materials, but in preferred practice the second plate member 12 is composed primarily of a plastic material. Typically, plastic materials have exceptional moldability (degree of freedom in molding), and can be implemented in a favorable manner for the manufacture of various shapes of faceplates for a timepiece 1. Also, where the second plate member 12 is composed of a plastic material, there is an advantage in terms of reducing manufacturing cost of the timepiece faceplate 1. Also, because plastic materials typically have exceptional transmission of light (visible light), as well as exceptional transmission of radio waves, where the second plate member 12 is composed of a plastic material, the timepiece faceplate 1 can be implemented favorably in a radio wave timepiece as described below. The following description is centered on a description of an example of the second plate member 12 composed primarily of plastic materials.

Various types of thermoplastic resins, various types of thermal curing resins, and the like may be cited as plastic materials for composing the second plate member 12; for example, there can be cited polycarbonate (PC), acrylonitrile-butadiene-styrene copolymer (ABS resin), polymethyl methacrylate (PMMA), and other acrylic resins, polyethylene (PE), polypropylene (PP), and other polyolefin resins, polyethylene terephthalate (PET) and other polyester resins, as well as copolymers, blends, and polymer alloys having these as the primary component. A single type, or two or more types of these, may be used in combination (for example, in the form of a blended resin, a polymer alloy, a laminate body or the like). In particular, the second plate member 12 is preferably composed primarily of polymethyl methacrylate and/or polyethylene terephthalate. In so doing, a particularly exceptional level of strength can be imparted to the timepiece faceplate 1 as a whole. Also, because of the increased degree of freedom of molding (improved ease of molding) of the second plate member 12, a timepiece faceplate 1 of a more complex shape can be manufactured easily and reliably.

The second plate member 12 may contain components besides plastic material. As examples of such components, there may be cited, for example, plasticizers, antioxidants, colorants (including various types of color formers, fluorescent materials, phosphorescent materials, and the like), brightening agents, fillers, and the like. For example, where the second plate member 12 is composed of material containing colorants, the variation of colors of the timepiece faceplate 1 can be expanded.

The second plate member 12 may have a substantially uniform composition in each region thereof, or a composition that differs by region. The refractive index (absolute refractive index) of the second plate member 12 is preferably from 1.450 to 1.650, and more preferably from 1.470 to 1.600. In so doing, reflection and scattering of light as discussed in detail below can be favorably produced, and the timepiece faceplate 1 can be imparted with both exceptional aesthetic appearance and transmission of light. The second plate member 12 has on the second face 122 thereof, which is a principal face on the opposite side from the first face 121, fine asperities 123 having the function of reflecting and scattering light impinging from the first face 121 side.

Incidentally, because the second plate member 12 has optical transmission, part of the light transmitted through the first plate member 11 enters into the interior of second plate member 12. The light entering into the interior of the second plate member 12 advances from the first face 121 side towards the second face 122 side, and a portion thereof exits from the second face 122 side (more specifically, is transmitted through the second plate member 12), but the remaining portion is reflected and scattered by the asperities 123 been provided on the second face 122. In so doing, the light which has entered into the interior of the second plate member 12 from the first face 121 side can be made to re-exit toward the first plate member from the first face 121 side. In this way, light exiting toward the first plate member 11 experiences further reflection, scattering, and the like at the second face 112 and the first face 111 of the first plate member 11. In this way, in the timepiece faceplate 1, impinging light experiences reflection, scattering, transmission, and the like in a complex fashion by the first plate member 11 and the second plate member 12, whereby the optical transmission (the light exiting from the second face 122 of the second plate member 12 as a proportion of the light irradiating the timepiece faceplate 1) of the timepiece faceplate 1 as a whole can be made sufficiently high, while making the condition of the back face side of the timepiece faceplate 1 (in FIG. 1, the lower side of the timepiece faceplate 1) not readily visible to the observer. As a result, the timepiece faceplate 1 as a whole can be imparted with exceptional optical transmission, while imparting an exceptional aesthetic appearance to the timepiece faceplate 1.

While any number of dispositions of the asperities 123 are possible, in preferred practice they are disposed in a regular fashion, when the second plate member 12 is viewed in plan view. In so doing, the occurrence of unintentional color irregularities and the like can effectively be prevented in regions of the timepiece faceplate 1 (regions seen in plan view). As patterns of disposition of the asperities 123 (patterns of disposition seen in plan view) there can be cited, for example, a pattern of a multitude of raised ribs and grooves disposed in a one-dimensional direction (see FIG. 4), a pattern of a multitude of raised ribs and grooves disposed in two-dimensional directions (see FIGS. 5, 6), or the like. These also exemplify patterns of disposition of the asperities 113 present on the first plate member 11 discussed previously.

Among these patterns of disposition of the asperities 123, one having a plurality of linear raised ribs and grooves provided substantially parallel, with the timepiece faceplate 1 seen in plan view is especially preferred. In so doing, a particularly exceptional aesthetic appearance can be imparted to the timepiece faceplate 1. In particular, in a case where the asperity pattern of the asperities 113 of the first plate member 11 is a pattern of a plurality of raised ribs and grooves disposed in concentric circles, effects such as the aforedescribed can be brought about more prominently in a case where the asperity pattern of the asperities 123 of the second plate member 12 is one having a plurality of linear raised ribs and grooves provided substantially parallel.

While the average of the pitch (in particular, the pitch for a direction perpendicular to the lengthwise direction of the raised ribs and grooves on the second face 122) $P_2$ (average pitch) of the asperities 123 is not limited to any particular value, it is preferably from 10 μm to 25 μm, and more preferably 13 μm to 23 μm. Where the average of the pitch $P_2$ (average pitch) of the asperities 123 is a value within the aforedescribed range, a particularly exceptional aesthetic appearance can be imparted to the timepiece faceplate 1.

While the average of the height differential (the height differential of the apical portion of the raised portions (raised ribs) and the floor portion of the recessed portions (grooves)) $H_2$ (average height differential) of the asperities 123 is not limited to any particular value, it is preferably 5 μm or more to 12.5 μm or less, and more preferably from 6.5 μm to 11.5 μm. Where the average of the height differential $H_2$ (average height differential) of the asperities 123 is a value within the aforedescribed range, a particularly exceptional aesthetic appearance can be imparted to the timepiece faceplate 1, while imparting the timepiece faceplate 1 with sufficiently high transmission of light.

In the illustrated configuration, the cross-sectional shape (the shape in a cross-section perpendicular to the lengthwise direction of the raised ribs and grooves) of the asperities 123 is that of an isosceles triangle. Where the asperities 123 have this cross-sectional shape, light impinging from the first face 121 side can be appropriately reflected and scattered, and particularly high levels of both transmission of light and aesthetic appearance of the timepiece faceplate 1 can be attained. While the apical portion of the asperities 123 ($\theta_2$ in the drawing) is not limited to any particular angle, it is preferably from 70° to 100°, and more preferably 90°. In so doing, light impinging from the first face 121 side can be appropriately reflected and scattered, and extremely high levels of both transmission of light and aesthetic appearance of the timepiece faceplate 1 can be attained.

The first face 121 of the second plate member 12 is preferably a relatively flat (smooth) one. In so doing, a particularly exceptional aesthetic appearance is imparted to the timepiece faceplate 1. The first face 121 of the second plate member 12 may be provided with a motif such as a radial shape, a vortex, or the like. In so doing, variations in the design of the timepiece faceplate 1 can be expanded, and a particularly exceptional aesthetic appearance can be imparted to the timepiece faceplate 1. The surface roughness Ra of the first face 121 is preferably from 0.001 μm to 5.0 μm, and more preferably 0.001 μm to 2.5 μm. In so doing, effects such as the aforedescribed can be brought about even more prominently. The shape and size of the second plate member 12 are not given by way of any particular limitation; they are ordinarily determined based on the shape and size of the timepiece faceplate 1 to be manufactured. In the illustrated configuration, the second plate member 12 is one with a flat shape, but one with, e.g., a curved plate shape or the like is also acceptable.

The average thickness of the second plate member 12 is not limited to any particular one, but is preferably from 50 μm to 100 μm, more preferably from 55 μm to 95 μm, and even more preferably from 60 μm to 90 μm. Where the average thickness of the second plate member 12 is a value within the aforedescribed range, in the case of implementation of the timepiece faceplate 1 in a solar timepiece, the inherent color of the solar battery can be more effectively prevented from showing through the timepiece faceplate 1, while still having sufficiently high optical transmission, and a particularly exceptional aesthetic appearance (high-quality feel) can be imparted. Also, where the average thickness of the second plate member 12 is a value within the aforedescribed range, the timepiece faceplate 1 can be imparted with sufficiently exceptional mechanical strength, stability of shape, and the like, while effectively preventing any increase in thickness of the profile of the timepiece in which the timepiece faceplate 1 is implemented.

Also, while any method may be used to mold the second plate member 12, compression molding, extrusion molding, injection molding, optical fabrication, or the like may be cited as examples of the molding method used for the second plate member 12. Also, a second plate member 12 provided with the asperities 123 may be manufactured by preparing a plate member devoid of asperities, and then performing a cutting operation or other process thereon. In the timepiece faceplate 1 of the present embodiment, the first plate member 11 and the second plate member 12 are caused to make close contact.

The average thickness of the timepiece faceplate 1 is not limited to any particular one, but is preferably from 150 μm to 600 μm, more preferably from 200 μm to 600 μm, and even more preferably from 300 μm to 500 μm. Where the average thickness of the timepiece faceplate 1 is a value within the aforedescribed range, the timepiece faceplate 1 can be imparted with sufficiently exceptional mechanical strength, stability of shape, and the like, while effectively preventing any increase in thickness of the profile of the timepiece in which the timepiece faceplate 1 is implemented.

In the illustrated configuration, the first plate member and the second plate member are caused to make close contact, but it is acceptable for first plate member 11 and the second plate member 12 to not be in close contact, but for a predetermined gap to be provided therebetween. The timepiece faceplate 1 may have a coating layer (not shown). As discussed previously, the timepiece faceplate 1 is imparted with exceptional aesthetic appearance, as well as exceptional transmission of light. Because of this, the timepiece faceplate 1 can be favorably implemented in a solar timepiece (a timepiece with an internal solar battery) or the like. Because the timepiece faceplate 1 excels in durability as well, it can be favorably implemented in a portable timepiece (e.g., a wristwatch).

Timepiece

There shall now be provided a description of a timepiece of the invention provided with the timepiece faceplate of the invention as set forth above. The timepiece of the invention has the timepiece faceplate of the invention as set forth above. As set forth above, the timepiece faceplate of the invention is with exceptional optical transmission and decorative properties (aesthetic appearance). Because of this, the timepiece of the invention provided with such a timepiece faceplate can sufficiently fulfill the requirements for a solar timepiece. Apart from the timepiece faceplate (the timepiece faceplate of the invention) constituting the timepiece of the invention, parts known in the art may be used. An example of a configuration of the timepiece of the invention is described below.

Figure 7:
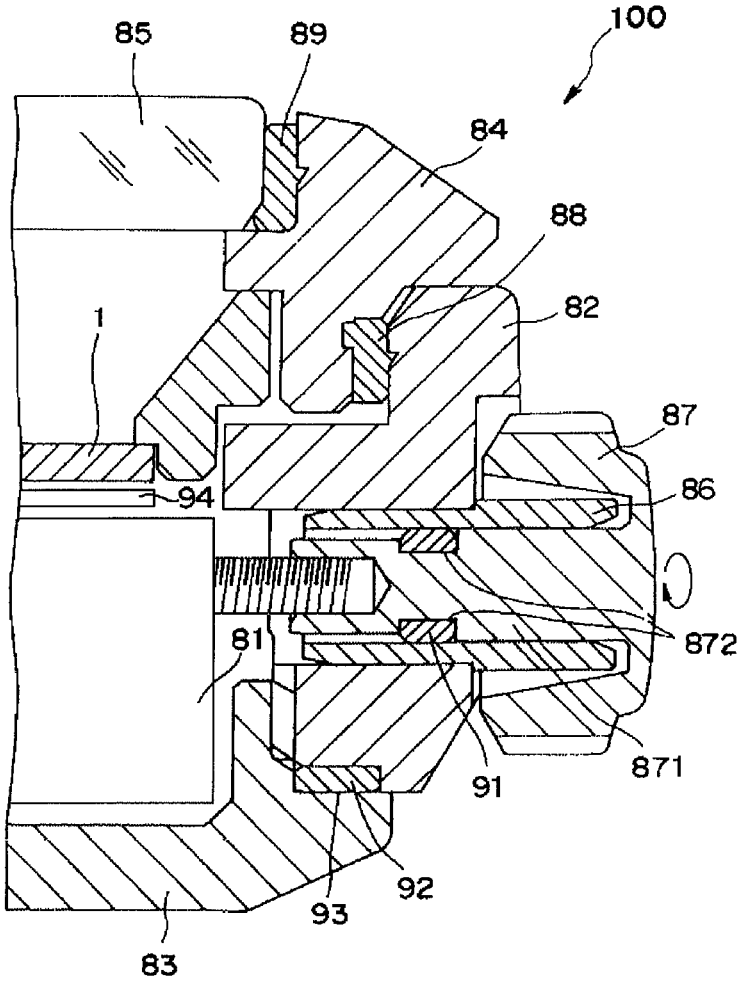
FIG. 7 is a partly cross sectional view showing a preferred embodiment of a timepiece (portable timepiece) of the invention.

FIG. 7 is a cross sectional view showing a preferred embodiment of a timepiece (a wristwatch) of the invention. As shown in FIG. 7, the wristwatch (portable timepiece) 100 of the present embodiment is provided with a barrel (case) 82, a back cover 83, a bezel (rim) 84, and a glass plate (cover glass) 85. Also, inside the case 82 there are housed the timepiece faceplate 1 of the invention as set forth previously, a solar battery 94, and a movement 81; hands (indicators; not shown), and the like are housed therein as well. The timepiece faceplate 1 is provided between the solar battery 94 and the glass plate (cover glass) 85, with the first face 111 of the first plate member 11 disposed so as to face toward the glass plate (cover glass) 85 side.

The glass plate 85 is typically composed of high-transparency transparent glass, sapphire, or the like. In so doing, the timepiece faceplate 1 of the invention can be made to exhibit an adequate level of attractiveness, and a sufficient quantity of light can be caused to impinge on the solar battery 94. The movement 81 utilizes the electromotive force of the solar battery 94 to drive the hands. Inside the movement 81 there are provided, for example, an electric double layer capacitor or lithium ion secondary cell for storing the electromotive force of the solar battery 94, a liquid crystal oscillator serving as a time reference source, a semiconductor integrated circuit for generating a drive pulse to drive the timepiece on the basis of the oscillation frequency of the liquid crystal oscillator, a step motor for receiving this drive pulse and driving the hands every second, a going train mechanism for transmitting motion of the step motor to the hands, and the like. These components are not shown in FIG. 7.

The movement 81 is also provided with an antenna (not shown) for receiving radio waves. It also has a function for carrying out time adjustment or the like using received radio waves. The solar battery 94 has a function of converting light energy to electrical energy. The electrical energy converted by the solar battery 94 is then utilized for driving the movement or for other tasks. The solar battery 94 has, for example, a pin structure in which p-type impurities and n-type impurities have been selectively introduced into non-single-crystalline silicon thin films, and an i-type non-single-crystalline silicon thin film having a low impurity concentration is provided between a p-type non-single-crystalline silicon thin film and an n-type non-single-crystalline silicon thin film.

A crown tube 86 is fitted into and fastened to the case 82, and a shaft portion 871 of a winder 87 is rotatably inserted into the interior of this crown tube 86. The case 82 and the bezel 84 are fastened by a plastic packing 88, and the bezel 84 and the glass plate 85 are fastened by a plastic packing 89. Also, the back cover 83 is mated (or threaded) together with the case 82, and a ring-shaped rubber packing (back cover packing) 92 is interposed in a compressed state in the joining portion (seal portion) 93 of these. Through this configuration, the seal portion 93 is sealed fluidtightly, to obtain a watertight function.

A groove 872 is formed midway along the outside periphery of the shaft portion 871 of the winder 87, and a ring-shaped rubber packing (winder packing) 91 is mated inside this groove 872. The rubber packing 91 intimately contacts the inside peripheral face of the crown tube 86, and is compressed between the inside peripheral face thereof and the inside face of the groove 872. Through this configuration, the winder 87 and the crown tube 86 are sealed fluidtightly, to obtain a watertight function. When the winder 87 undergoes a winding operation, the rubber packing 91 rotates together with the shaft portion 871, and slides in the circumferential direction while being in close contact with the inside peripheral face of the crown tube 86. Because particularly exceptional durability (for example, shock resistance and the like) is required of portable timepieces (wristwatches) such as the aforedescribed from among timepieces of various kinds, the invention, which affords exceptional aesthetic appearance as well as exceptional durability, can be implemented even more appropriately.

In the aforedescribed description, a wristwatch (portable timepiece) was cited as a solar/radio wave timepiece when an example of a timepiece was described, but the invention can be implemented analogously in portable timepieces besides wristwatches, or in other types of timepieces such as table clocks, wall clocks, and the like. Also, the invention can be implemented in solar timepieces exclusive of solar/radio wave timepieces, in radio wave timepieces exclusive of solar/radio wave timepieces, or in any other timepiece. While the preferred embodiment of the invention has been described above, the invention is not limited to that described above.

For example, the configurations of various portions in the timepiece faceplate and the timepiece of the invention can be replaced with any configuration that brings about a similar function, and any configurations can be added as well. For example, faceplates may have a printed portion formed by various printing methods. Also, at least one layer may be provided on the front face of the first plate member and/or the second plate member. A layer of this sort may be removed, for example, at the time of use of the timepiece faceplate.

In the embodiment set forth previously, the asperities present on the first plate member were described as being provided to the entire second face, but may be provided selectively to only a portion or portions of the second face. Also, similarly, while the asperities present on the second plate member were described as being provided to the entire second face, they may be provided selectively to only a portion or portions of the second face.

EXAMPLES

Next, specific examples of the invention are described.

1. Manufacture of Timepiece Faceplate

For each of several examples and comparative examples, 100 faceplates for a timepiece (faceplates for a wristwatch) were manufactured by a method such as that shown below.

Example 1

First, using polycarbonate, a preform having the shape of a wristwatch faceplate was fabricated by injection molding, and was thereafter punched out at the necessary locations, and unwanted burring and other matter was cut or ground away to obtain a first plate member. The first plate member so obtained was an approximately circular disk measuring 27 mm in diameter and having an average thickness of 250 μm. In the first plate member so obtained, a first face constituting one of the principal faces was flat and the surface roughness Ra of the first face was 0.07 μm, while the entirety of a second face constituting the principal face on the opposite side from the first face had a pattern of asperities composed of a plurality of raised ribs and grooves provided in a regular fashion in concentric circles (see FIG. 2). The pitch of the asperities was 50 μm. The height differential of the asperities (the height differential of the apical portion of the raised ribs and the floor portion of the grooves) was 25 μm. The cross-sectional shape of the asperities was that of an isosceles triangle, and the angle of the apical portion of the asperities ($\theta_1$ in FIG. 1) was 90°.

Next, using polycarbonate, a preform having the shape of a wristwatch faceplate was fabricated by injection molding, and thereafter was punched out at the necessary locations, and unwanted burring and other matter was cut or ground away to obtain a second plate member. The second plate member so obtained was an approximately circular disk having a diameter of 27 mm and an average thickness of 250 μm. In the second plate member so obtained, a first face constituting one of the principal faces was flat and the surface roughness Ra of the first face was 0.07 μm, while the entirety of a second face constituting the principal face on the opposite side from the first face had a pattern of asperities composed of a plurality of linear raised ribs and grooves provided in parallel in a one-dimensional direction (regular asperity pattern) (see FIG. 4). The pitch of the asperities was 19 μm. The height differential of the asperities (the height differential of the apical portion of the raised ribs and the floor portion of the grooves) was 9.5 μm. The cross-sectional shape of the asperities was that of an isosceles triangle, and the angle of the apical portion of the asperities ($\theta_2$ in FIG. 1) was 90°. Thereafter, the second face of the first plate member and the first face of the second plate member were juxtaposed so as to make contact, resulting in a timepiece faceplate.

Examples 2-14

Faceplates for a wristwatch were manufactured in the same manner as the aforedescribed Example 1, except that the constituent materials and average thickness of the first plate member and the second plate member, and the conditions of the asperities present by the first plate member and the second plate member, were as shown in Table 1.

Comparative Example 1

Faceplates for a timepiece were manufactured in the same manner as the aforedescribed Example 1, except that no second plate member was manufactured, and the faceplates were composed of the first plate member only.

Comparative Example 2

Faceplates for a timepiece were manufactured in the same manner as the aforedescribed Example 1, except that no first plate member was manufactured, and the faceplates were composed of the second plate member only.

Comparative Example 3

Faceplates for a timepiece were manufactured in the same manner as the aforedescribed Comparative Example 1, except that the average thickness of the first plate member was modified as shown in Table 1.

Comparative Example 4

Faceplates for a timepiece were manufactured in the same manner as the aforedescribed Comparative Example 2, except that the average thickness of the second plate member was modified as shown in Table 1.

Comparative Example 5

Using polycarbonate, a preform having the shape of a wristwatch faceplate was fabricated by injection molding, and thereafter was punched out at the necessary locations. Unwanted burring and other matter was cut or ground away to obtain a timepiece faceplate. The resulting timepiece faceplate was an approximately circular disk having a diameter of 27 mm and an average thickness of 500 μm. In the resulting timepiece faceplate, a first face constituting one of the principal faces was flat and the surface roughness Ra of the first face was 0.07 μm, while the entirety of a second face constituting the principal face on the opposite side from the first face had a pattern of asperities of a juxtaposed pattern of asperities of plurality of raised ribs and grooves provided in a regular fashion in concentric circles, and a pattern of asperities composed of a plurality of linear raised ribs and grooves provided in parallel in a one-dimensional direction (regular asperity pattern) (see FIG. 8). The pitch of the asperities provided in concentric circles was 50 μm. The height differential (the height differential of the apical portion of the raised ribs and the floor portion of the grooves) of the asperities provided in concentric circles was 25 μm. The cross-sectional shape of the asperities provided in concentric circles was that of an isosceles triangle, and the angle of the apical portion of the asperities was 90°. The pitch of the plurality of linear asperities provided in parallel in a one-dimensional direction was 19 μm. The height differential (the height differential of the apical portion of the raised ribs and the floor portion of the grooves) of the plurality of linear asperities provided in parallel in a one-dimensional direction was 9.5 μm. The cross-sectional shape of the plurality of linear asperities provided in parallel in a one-dimensional direction was that of an isosceles triangle, and the angle of the apical portion of the asperities was 90°.

Comparative Example 6

Using polycarbonate, a preform having the shape of a wristwatch faceplate was fabricated by injection molding, and thereafter was punched out at the necessary locations. Unwanted burring and other matter was cut or ground away to obtain a timepiece faceplate. The resulting timepiece faceplate was an approximately circular disk having a diameter of 27 mm and an average thickness of 500 μm. In the resulting timepiece faceplate, the entirety of a first face constituting one of the principal faces had a pattern of asperities composed of a plurality of raised ribs and grooves provided in a regular fashion in concentric circles (see FIG. 2). The pitch of the asperities provided on the first face was 50 μm. The height differential of the asperities (the height differential of the apical portion of the raised ribs and the floor portion of the grooves) provided on the first face was 25 μm. The cross-sectional shape of the asperities provided on the first face was that of an isosceles triangle, and the angle of the apical portion of the asperities was 90°.

The timepiece faceplate obtained thereby, on the entirety of a second face constituting the principal face on the opposite side from the first face thereof, had a pattern of asperities composed of a plurality of linear raised ribs and grooves provided in parallel in a one-dimensional direction (regular asperity pattern) (see FIG. 4). The pitch of the asperities provided on the second face was 19 μm. The height differential of the asperities (the height differential of the apical portion of the raised ribs and the floor portion of the grooves) provided on the second face was 9.5 μm. The cross-sectional shape of the asperities provided on the second face was that of an isosceles triangle, and the angle of the apical portion of the asperities was 90°. When a white fluorescent bulb (an FL20S -D65 fluorescent bulb for inspection purposes, made by Toshiba) was used as the light source, the transmittance of visible light of the plate members used in the aforedescribed examples and comparative examples was 60% or more in each case.

Figure 8:
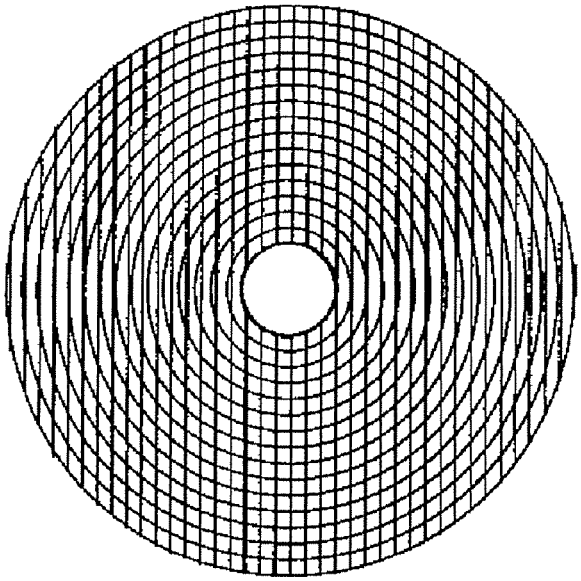
FIG. 8 is a plan view showing in model form an example of a pattern of disposition of asperity possessed by a timepiece faceplate of a fifth comparative example.

The configurations of the faceplates for a timepiece of the aforedescribed examples and comparative examples are shown together in Table 1. In the table, polycarbonate is shown by PC; acrylonitrile-butadiene-styrene copolymer (ABS resin) by ABS; and acrylic resin by Ac. In Table 1, in the "Asperity pattern" column, a pattern of a plurality of raised ribs and grooves disposed in concentric circles as shown in FIG. 2 is shown by "a;" a pattern of a raised rib and a groove disposed in a whorl as shown in FIG. 3 is shown by "b;" a pattern of a multitude of raised ribs and grooves disposed in a one-dimensional direction as shown in FIG. 4 is shown by c;" a pattern of a multitude of raised ribs and grooves disposed in two-dimensional directions as shown in FIG. 5 is shown by "d;" a pattern of a multitude of raised ribs and grooves disposed in two-dimensional directions as shown in FIG. 6 is shown by "e;" and a pattern like that shown in FIG. 8 is shown by "f." Each region of all of the faceplates for a timepiece comprised the component indicated in Table 1 as the principal component, with the amount of other components being less than 0.1 wt %. For Comparative Examples 5 and 6, the configuration of the timepiece faceplate is shown in the first plate member column.

TABLE 1

| | First plate member | | | | | | | | Second plate member | | | | | | |
|---|---|---|---|---|---|---|---|---|---|---|---|---|---|---|---|
| | | | Avg. | Asperity | | | | | | | Avg. | Asperities | | | |
| | Constituent material | Refractive index | thickness (μm) | Asperity pattern | | Pitch $P_1$ (μm) | Height diff. $H_1$ (μm) | Apical angle $\theta_1$ (°) | Constituent mat'l | Refractive index | thickness (μm) | Asperity pattern | Pitch $P_2$ (μm) | Height diff. $H_2$ (μm) | Apical angle $\theta_2$ (°) |
| Ex. 1 | PC | 1.586 | 250 | a | | 50 | 25 | 90 | PC | 1.586 | 250 | c | 19 | 9.5 | 90 |
| Ex. 2 | PC | 1.586 | 400 | a | | 50 | 25 | 90 | PET | 1.576 | 64 | c | 19 | 9.5 | 90 |
| Ex. 3 | PC | 1.586 | 150 | a | | 30 | 15 | 90 | PC | 1.586 | 350 | d | 13 | 6.5 | 90 |
| Ex. 4 | PC | 1.586 | 350 | a | | 70 | 35 | 90 | PC | 1.586 | 150 | e | 23 | 11.5 | 90 |
| Ex. 5 | ABS | 1.571 | 250 | b | | 50 | 25 | 90 | ABS | 1.571 | 250 | c | 19 | 9.5 | 90 |
| Ex. 6 | PC | 1.586 | 120 | a | | 28 | 14 | 90 | PC | 1.586 | 380 | c | 12 | 6 | 90 |
| Ex. 7 | PC | 1.586 | 380 | a | | 72 | 36 | 90 | PC | 1.586 | 120 | c | 24 | 12 | 90 |
| Ex. 8 | PC | 1.586 | 250 | a | | 25 | 12.5 | 90 | PC | 1.586 | 250 | c | 10 | 5 | 90 |
| Ex. 9 | PC | 1.586 | 250 | a | | 100 | 50 | 90 | PC | 1.586 | 250 | c | 25 | 12.5 | 90 |
| Ex. 10 | PC | 1.586 | 410 | a | | 24 | 12 | 90 | PC | 1.586 | 90 | c | 9 | 4.5 | 90 |
| Ex. 11 | PC | 1.586 | 90 | a | | 102 | 51 | 90 | PC | 1.586 | 410 | c | 26 | 13 | 90 |
| Ex. 12 | PC | 1.586 | 250 | a | | 50 | 43.3 | 60 | PC | 1.586 | 250 | c | 20 | 17.3 | 60 |
| Ex. 13 | PC | 1.586 | 250 | a | | 50 | 28.9 | 120 | PC | 1.586 | 250 | c | 20 | 11.5 | 120 |
| Ex. 14 | Ac | 1.490 | 250 | a | | 50 | 25 | 90 | Ac | 1.490 | 250 | c | 19 | 9.5 | 90 |
| Comp. Ex. 1 | PC | 1.586 | 250 | a | | 50 | 25 | 90 | — | — | — | — | — | — | — |
| Comp. Ex. 2 | — | — | — | — | | — | — | — | PC | 1.586 | 250 | c | 19 | 9.5 | 90 |
| Comp. Ex. 3 | PC | 1.586 | 500 | a | | 50 | 25 | 90 | — | — | — | — | — | — | — |
| Comp. Ex. 4 | — | — | — | — | | — | — | — | PC | 1.586 | 500 | c | 19 | 9.5 | 90 |
| Comp. Ex. 5 | PC | 1.586 | 500 | f | Concentric | 50 | 25 | 90 | — | — | — | — | — | — | — |
| | | | | | Linear | 19 | 9.5 | 90 | | | | | | | |
| Comp. Ex. 6 | PC | 1.586 | 500 | a | 1st face | 50 | 25 | 90 | — | — | — | — | — | — | — |
| | | | | c | 2nd face | 19 | 9.5 | 90 | | | | | | | |

2. Evaluation of Appearance of Faceplates for a Wristwatch

The faceplates for a wristwatch manufactured in the aforedescribed examples and comparative examples were subjected to visual examination, and their appearance was evaluated according to the seven-step scale below. For the faceplates for a timepiece of the examples, the examination was carried out from the first face side of the first plate member; for the faceplates for a timepiece of Comparative Examples 1 to 5, the examination was carried out from the flat face (the face opposite from the face provided with asperity) side; and for the faceplates for a timepiece of Comparative Example 6, the examination was carried out from the side of the face provided with a pattern of asperities composed of a plurality of raised ribs and grooves provided in concentric circles.

A. Highly exceptional appearance
B. Very exceptional appearance
C. Exceptional appearance
D. Good appearance
E. Somewhat flawed appearance
F. Flawed appearance
G. Highly flawed appearance 3. Evaluation of Optical Transmission of Faceplates for a Wristwatch The optical transmission of the faceplates for a wristwatch manufactured in the aforedescribed examples and comparative examples was evaluated by the following method.

First, the solar battery and the wristwatch faceplate were placed in a dark room. Thereafter, light from a white fluorescent bulb (light source) a predetermined distance away was directed onto the light receiving face of the solar battery in isolation. The generated current of the solar battery at this time was designated as A (mA). Next, in a state with the wristwatch faceplate superimposed onto the upper face of the light receiving face of the solar battery, light from a white fluorescent bulb (light source) a predetermined distance away was directed thereon in the aforedescribed manner. The generated current of the solar battery in this state was designated as B (mA). Then, the transmittance of the timepiece faceplate, represented by (B/A)×100, was calculated, and evaluated according to the according to the five-step scale below. Higher light transmittance is considered to indicate exceptional optical transmission of the timepiece faceplate. The faceplates for a timepiece of the examples were superimposed on the solar battery such that the first face of the first plate member faced toward the white fluorescent bulb (light source) side; the faceplates for a timepiece of Comparative Examples 1 to 5 were superimposed on the solar battery such that the flat face (the face opposite from the face provided with asperities) faced toward the white fluorescent bulb (light source) side; and the faceplates for a timepiece of Comparative Example 6 were superimposed on the solar battery such that the face provided with a pattern of asperities composed of a plurality of raised ribs and grooves provided in concentric circles faced toward the white fluorescent bulb (light source) side.

A. 40% or above
B. 32% or above but less than 40%
C. 25% or above but less than 32%
D. 17% or above but less than 25%
E. Less than 17%

4. Evaluation of Radio Wave Transmission

Radio wave transmission of the faceplates for a timepiece manufactured in the aforedescribed examples and comparative examples was evaluated by a method as shown below.

First, a timepiece case, and an internal module (movement) for a wristwatch provided with an antenna for receiving radio waves, were prepared.

Next, the internal module (movement) for a wristwatch, together with the timepiece faceplate, were installed inside the timepiece case, and in this state the radio wave receiving sensitivity was measured. At this time, the faceplates for a timepiece of the examples were oriented such that the first face of the first plate member faced toward the outer front face side; the faceplates for a timepiece of Comparative Examples 1 to 5 were oriented such that the flat face (the face opposite from the face provided with asperity) faced toward the outer front face side; and the faceplates for a timepiece of Comparative Example 6 were oriented such that the face provided with a pattern of asperities composed of a plurality of raised ribs and grooves provided in concentric circles faced toward the outer front face side.

Based on the receiving sensitivity in a state without a wristwatch faceplate installed, the amount of decline in receiving sensitivity (dB) in cases where faceplates for a wristwatch were installed was evaluated on the basis of the following four-step scale. A lower decline in radio-wave-receiving sensitivity is considered to indicate higher radio wave transmission of the wristwatch faceplate.

A. No decline in sensitivity observed (below detection limit)

B. Decline in sensitivity of less than 0.7 dB observed

C. Decline in sensitivity equal to or greater than 0.7 dB, but less than 1.0 dB

D. Decline in sensitivity of greater than 1.0 dB

5. Evaluation of Stability of Color Tone

The faceplates for a wristwatch manufactured in the aforedescribed examples and comparative examples were left standing for 72 hours in a 75° C. (temperature) and 90% RH (humidity) environment, and immediately thereafter a visual examination was carried out, wherein the faceplates were evaluated according to the following five-step scale. For the faceplates for a timepiece of the examples, examination was carried out from the first face side of the first plate member; for the faceplates for a timepiece of Comparative Examples 1 to 5, examination was carried out from the flat face (the face opposite from the face provided with asperity) side; and for the faceplates for a timepiece of Comparative Example 6, examination was carried out from the side of the face provided with a pattern of asperities composed of a plurality of raised ribs and grooves provided in concentric circles.

A. No decline in attractiveness whatsoever observed

B. Substantially no decline in attractiveness observed

C. Slight decline in attractiveness observed

D. Distinct decline in attractiveness observed

E. Prominent decline in attractiveness observed.

These results are shown in Table 2.

TABLE 2

| | Appearance evaluation | Optical transmission | Radio wave transmission | Color tone stability |
|---|---|---|---|---|
| Example 1 | A | A | A | A |
| Example 2 | A | A | A | A |
| Example 3 | A | A | A | A |
| Example 4 | A | A | A | A |
| Example 5 | C | A | A | A |
| Example 6 | B | A | A | A |
| Example 7 | B | A | A | A |
| Example 8 | B | A | A | A |
| Example 9 | B | A | A | A |
| Example 10 | D | A | A | A |
| Example 11 | D | A | A | A |

TABLE 2-continued

| | Appearance evaluation | Optical transmission | Radio wave transmission | Color tone stability |
|---|---|---|---|---|
| Example 12 | D | A | A | A |
| Example 13 | D | A | A | A |
| Example 14 | C | A | A | A |
| Comp. Ex. 1 | F | A | A | A |
| Comp. Ex. 2 | F | A | A | A |
| Comp. Ex. 3 | F | A | A | A |
| Comp. Ex. 4 | F | A | A | A |
| Comp. Ex. 5 | G | A | A | A |
| Comp. Ex. 6 | F | A | A | A |

From Table 2, it is clear that the faceplates for a timepiece of the invention all have exceptional aesthetic appearance, as well as exceptional transmission of light. The faceplates for a timepiece of the invention also have exceptional transmission of radio waves. In contrast to this, results obtained in the comparative examples were unsatisfactory.

Using the faceplates for a timepiece obtained in the examples and comparative examples, timepieces like that shown in FIG. 7 were assembled. When testing and evaluation comparable to the aforedescribed were carried out on timepieces obtained in this manner, results comparable to the aforedescribed were obtained.

The entire disclosure of Japanese Patent Application No. 2010-272895, filed Dec. 7, 2010 is expressly incorporated by reference herein.

What is claimed is:

1. A timepiece faceplate, comprising a first plate member having an optical transmission property, the first plate member being integrally formed as a one-piece, unitary member; and a second plate member having an optical transmission property, the second plate member being integrally formed as a one-piece, unitary member, the first plate member including front and rear faces, the rear face of the first plate member facing the second plate member, the rear face of the first plate member being provided with first asperities having a function of reflecting and scattering light impinging thereon from the front face of the first plate member, the front face of the first plate member being disposed on an opposite side of the rear face of the first plate member, the second plate member including front and rear faces, the rear face of the second plate member being disposed on an opposite side of the front face of the second plate member, the front face of the second plate member facing the first plate member, the rear face of the second plate member being provided with second asperities having a function of reflecting and scattering light impinging thereon from the front face of the second plate member, the first and second plate members contacting with respect to each other such that the first asperities of the first plate member directly contact with the front face of the second plate member, the first asperities present on the first plate member being orderly arranged, with the average pitch thereof being 25 μm or more to 100 μm or less, the second asperities present on the second plate member being orderly arranged, with the average pitch thereof being 10 μm or more to 25 μm or less, each of the first asperities having a pair of first side surfaces that intersect with respect to each other to define a distal end of each of the first asperities, each of the second asperities having a pair of second side surfaces that intersect with respect to each other to define a distal end of each of the second asperities.

2. The timepiece faceplate according to claim 1, wherein the average height differential of the first asperities present on the first plate member is 12.5 μm or more to 50 μm or less.

3. The timepiece faceplate according to claim 1, wherein the first asperities present on the first plate member are arranged in a concentric circle pattern when the timepiece faceplate is seen in plan view.

4. The timepiece faceplate according to claim 1, wherein the average height differential of the second asperities present on the second plate member is 5 μm or more to 12.5 μm or less.

5. The timepiece faceplate according to claim 1, wherein the second asperities present on the second plate member have linear form, and are arranged substantially parallel to one another when the timepiece faceplate is seen in plan view.

6. A timepiece comprising the timepiece faceplate according to claim 1.

7. The timepiece faceplate according to claim 1, wherein the first side surfaces of each of the first asperities form an angle therebetween, and the second side surfaces of each of the second asperities form an angle therebetween.

* * * * *